United States Patent [19]

Passoni et al.

[11] 4,121,446

[45] Oct. 24, 1978

[54] HOUSING FOR A ROLLING MILL

[75] Inventors: Teresio Passoni, Magenta, Italy; Jean Paul Calmes, Lausanne, Switzerland

[73] Assignee: Innocenti Santeu-Stacchio, S.p.a., Brescia, Italy

[21] Appl. No.: 813,460

[22] Filed: Jul. 7, 1977

[30] Foreign Application Priority Data

Jul. 12, 1976 [IT] Italy ..... 25221 A/76

[51] Int. Cl.[2] ..... B21B 31/08

[52] U.S. Cl. ..... 72/238

[58] Field of Search ..... 72/208, 250, 238, 239, 72/97, 209

[56] References Cited

U.S. PATENT DOCUMENTS

| | | | |
|---|---|---|---|
| 3,566,653 | 3/1971 | Unrath | 72/238 |
| 4,006,618 | 2/1977 | Yanagimoto et al. | 72/209 |

*Primary Examiner*—Milton S. Mehr

*Attorney, Agent, or Firm*—Birch, Stewart, Kolasch & Birch

[57] ABSTRACT

The invention relates to a housing for a rolling mill for producing axially bored cylindrical blooms from square bars, the housing being of the kind substantially comprising a pair of cogging rollers having round grooves and associated bearing chocks mounted in the housing, an inlet guide for bearing a square bar to be rolled, an outlet guide for the board, rolled cylindrical bloom, and means for adjustably positioning the inlet guide relative to the rolling axis.

2 Claims, 4 Drawing Figures

HOUSING FOR A ROLLING MILL

BACKGROUND OF THE INVENTION

A rolling mill, which is hereinafter be referred to by the symbol PPM, is a machine which, because of its known high productive capacity, is advantageously used in pipe factories for manufacturing axially bored cylindrical blooms. A PPM comprises a rolling housing of the aforementioned kind together with an inlet frame extending parallel to the rolling axis and bearing a hydraulic or mechanical pusher rod for introducing a square bar between the cogging rollers. A second frame, likewise parallel to the rolling axis but at the outlet side of the housing, bears a rod which is hydraulically or mechanically driven in the direction of the rolling axis and bears a bit on which the square bar is rolled.

The second frame bears the apparatus and devices for withdrawing the cylindrical bloom from the bit after it has been rolled and for cooling the bit before it is used for manufacturing another cylindrical bloom.

In the case of a PPM, as in all complex machines of the same kind, special care is needed in the tooling-up operations which have to be performed before each production campaign, e.g. whenever, for manufacturing reasons, it is necessary to change the dimensions (i.e., change the calibre) of the perforated blooms to be manufactured, i.e., of the square bars for treatment.

The operation of tooling-up and sintering the rolling housing must be performed as quickly as possible so as not to affect the productivity of the machine.

In the prior art, in order to reduce the unproductive period, it is necessary to have a spare housing ready to replace the housing which has been previously in operation.

SUMMARY OF THE INVENTION

The invention provides a rolling mill for producing axially bored cylindrical blooms, using a rolling housing having structural characteristics which substantially reduce the aforementioned technical and economic disadvantage due to the unproductive calibre-changing period.

To this end, according to the present invention, the pair of cogging rollers, the associated bearing chocks, the inlet guide, the outlet guide and the means for adjustably positioning the inlet guide relative to the rolling axis form a monolithic working unit which can be fitted into and taken out of the housing.

The main advantage of the invention is that, while a PPM is operating at its full productive capacity, a working unit of the aforementioned kind is being provided with all its constituent components, so as to be ready to machine a calibre different from the one being produced.

The calibre on the PPM can be changed, when necessary, simply by replacing the working unit used in the PPM by a separately prepared working unit, by means of a quick easy operation.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Other features and advantages of the invention will be clear from the following description of an embodiment of a rolling-mill housing according to the invention with reference to the accompanying drawings which are given by way of illustration only, and thus are not limitative of the present invention, and wherein.

DETAILED DESCRIPTION OF THE INVENTION

Figure 1:
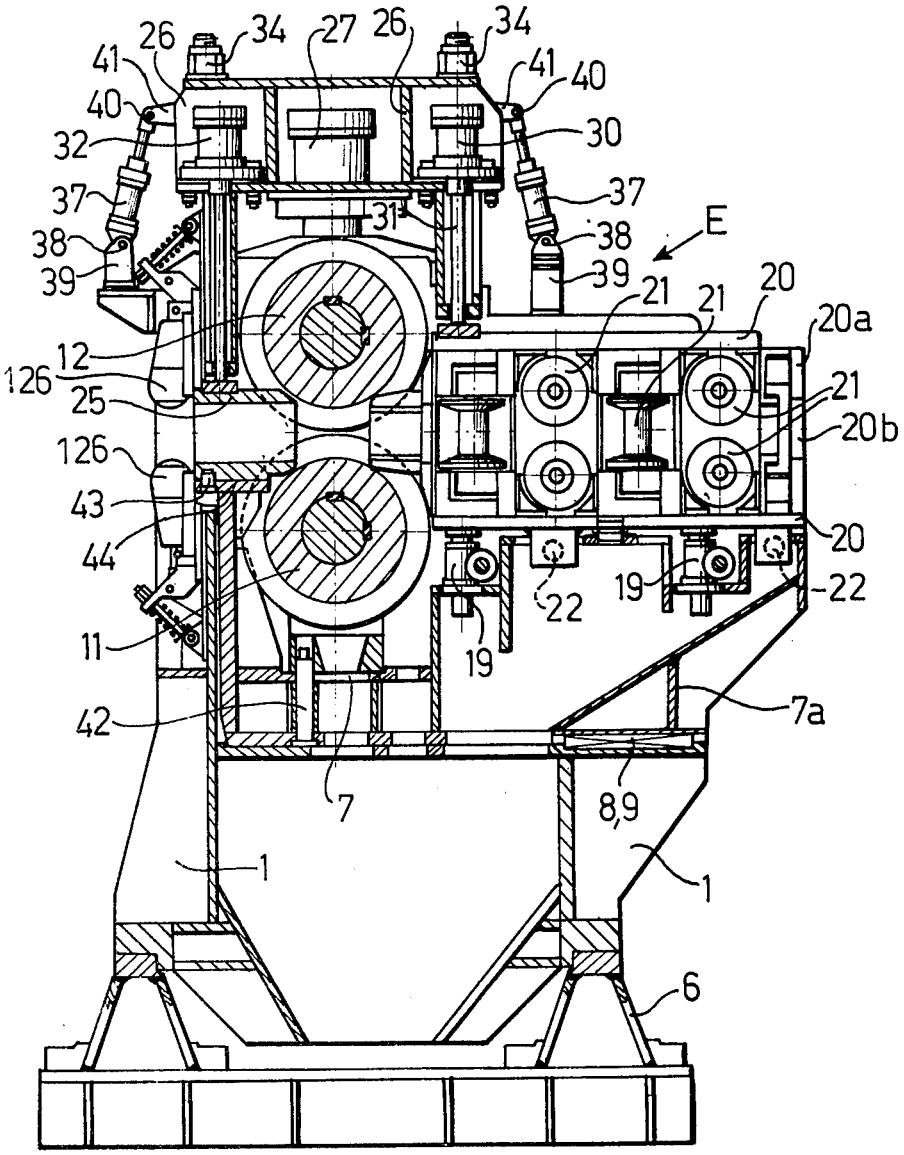
FIG. 1 shows a rolling-mill housing according to the invention in diagrammatic elevation and in section along a vertical plane extending through the rolling axis.
Figure 2:
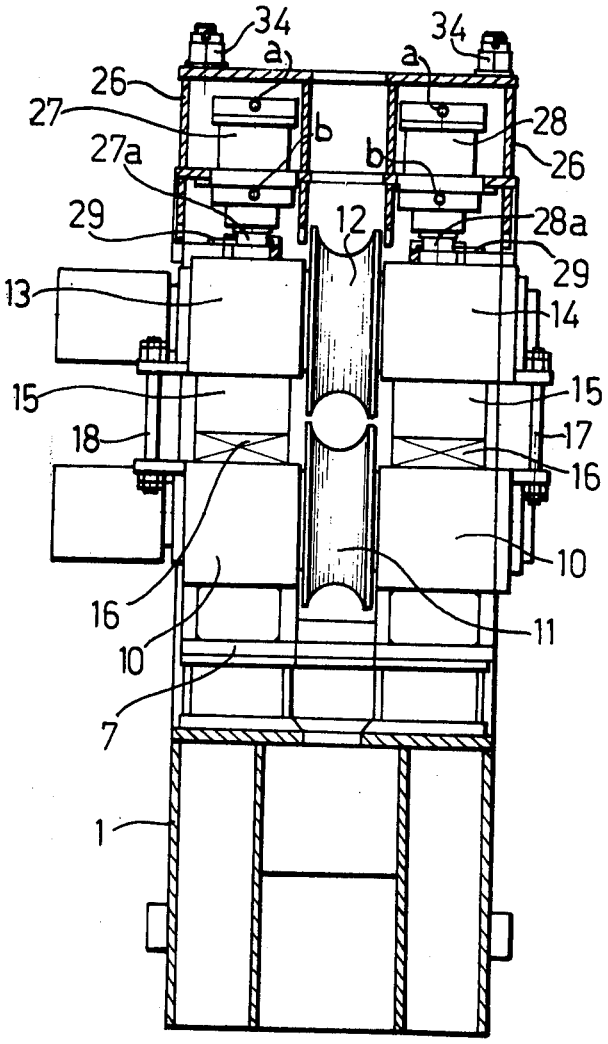
FIG. 2 is a diagrammatic vertical sectional view of FIG. 1.

The drawings show a rolling mill housing according to the invention comprising a bearing structure 1 having four top uprights 2, 3, 4, 5 and fitted and secured at the bottom to a base-frame 6. Reference 7 denotes a frame having bottom guides, diagrammatically indicated at 8, adapted to engage matching guides 9 formed in the bearing structure 1. The frame 7 is insertable between the housing uprights 2, 3, 4, 5 and movably securable in position by conventional means (not shown). A bottom chock 10 is secured by known means (not shown) in the frame and in conventional manner bears a corresponding working roller 11 having a semi-circular groove. A second working roller 12, likewise having a semi-circular groove, is borne by associated upper chocks 13, 14 resting on the bottom chock 10 with interposition of spacers 15 and load cells 16. The upper chocks 13, 14 are secured to the bottom chock 10 and consequently to frame 7, by pairs of tie-rods 17, 18.

Frame 7 comprises a bracket portion **7*a* extending between the pairs of uprights 2, 3 to the inlet side E of the housing. Part 7*a* has a number of mechanical jacks 19 bearing a guide 20 comprising rollers 21 forming an inlet guide in a conventional manner for introducing square bars B between the working rollers 11, 12. The roller guide 20, 21 which is closed from the inlet side by a part 20*a* having a calibrated orifice 20*b*, can be vertically adjusted by jacks 19, whereas it is laterally adjusted by two pairs of screws 22 which are manually adjusted and are rotatably secured by the bracket portion 7*a* of frame 7. Guide 20, 21 can also be laterally adjusted by using jacks 23 and oleodynamic cylinder 24 (FIG. 4) actuated either alternately or in co-operation with screws 22. Frame 7 bears an outlet guide 25 coaxial with the rolling axis defined by rollers 11, 12 and at the opposite end by the inlet guide 20, 21. Immediately downstream of guide 25, the bearing structure 1 of the housing bears a pair of driven rollers 126** (pinch-roll) for extracting short bored blooms.

At the top, uprights 2, 3, 4, 5 are enclosed in a cap 26 adapted to prevent the uprights from being bent during operation of the housing. Gap 26 bears two double-acting, axially vertical oleodynamic cylinders 27, 28 having rods **27*a*, 28*a* respectively which act on the top chocks 13, 14 to which they are mechanically and removably connected in a conventional manner, e.g. by shackles 29. Cap 26 likewise bears a double-acting, axially vertical oleodynamic cylinder 30 having a rod 31 acting on the inlet guide 20** to secure it during operation of the machine.

An additional double-acting, axially vertical oleodynamic cylinder 32 is borne by cap 26 and is used for securing the outlet guide 25 (FIG. 1). The reaction of cap 26 is withstood by nuts 34 in co-operation with four tie-rods 35, each secured to an upright 2, 3, 4, 5 respectively by a corresponding pin 36. Each tie-rod 35 can be moved through an angle relative to the associated pin 36 by a corresponding oleodynamic cylinder 37, one end of which is pivoted at 38 to a support 39 secured to the housing, whereas the other end is pivoted at 40 to a support 41 secured in conventional manner (not shown) to the associated tie-rod 35.

In the previously-described housing, the frame 7 the working rollers 11, 12 and associated chocks 10, 13 14, the inlet guide 20, 21, the associated jacks 19, the screws 22 for horizontally and adjustably positioning the inlet guide, and the outlet guide 25 form a monolithic unit which can be fitted into and taken out of the housing.

During the time when a PPM is producing axially bored cylindrical blooms having a set calibre, a fresh working unit of the aforementioned kind is fitted out for machining a different calibre. To this end, the bottom working roller 11 in the associated single chock 10 is first mounted on a suitably-supported frame 11; during this process, roller 11 is exactly positioned along the rolling axis since chock 10 is guided by a dowel 42 (FIG. 1) disposed in frame 7. Next, the outlet guide 25 is positioned and exactly aligned along the rolling axis by two dowels 43 disposed on a shelf 44 formed on frame 7 and adapted to support guide 25. With regard to the aforementioned positioning operations, the only error which can be made in the position of pin 42 and pin 43 is due to the normal working tolerance allowed for the machine tools. This tolerance cannot have an adverse effect on rolling.

After the rolling axis has been set up as described, the inlet guide 20, 21 is assembled by placing it on the plurality of mechanical jacks 19 provided in frame 7. The outlet guide 20 is vertically adjusted by means of jack 19, and laterally adjusted by manually acting on the pairs of screws 22. Next, the loading cells 16 and spacers 15 (having predetermined thicknesses) are mounted on the bottom chock 10, after which the top chocks 13, 14 of roller 12 are placed in position. By means of a suitable device 8, the rolling axis is sighted among all the previously-described components mounted in frame 7; at the end of this operation, the aforementioned assembly is secured by tie-rods 7, thus obtaining the desired working unit.

Figure 3:
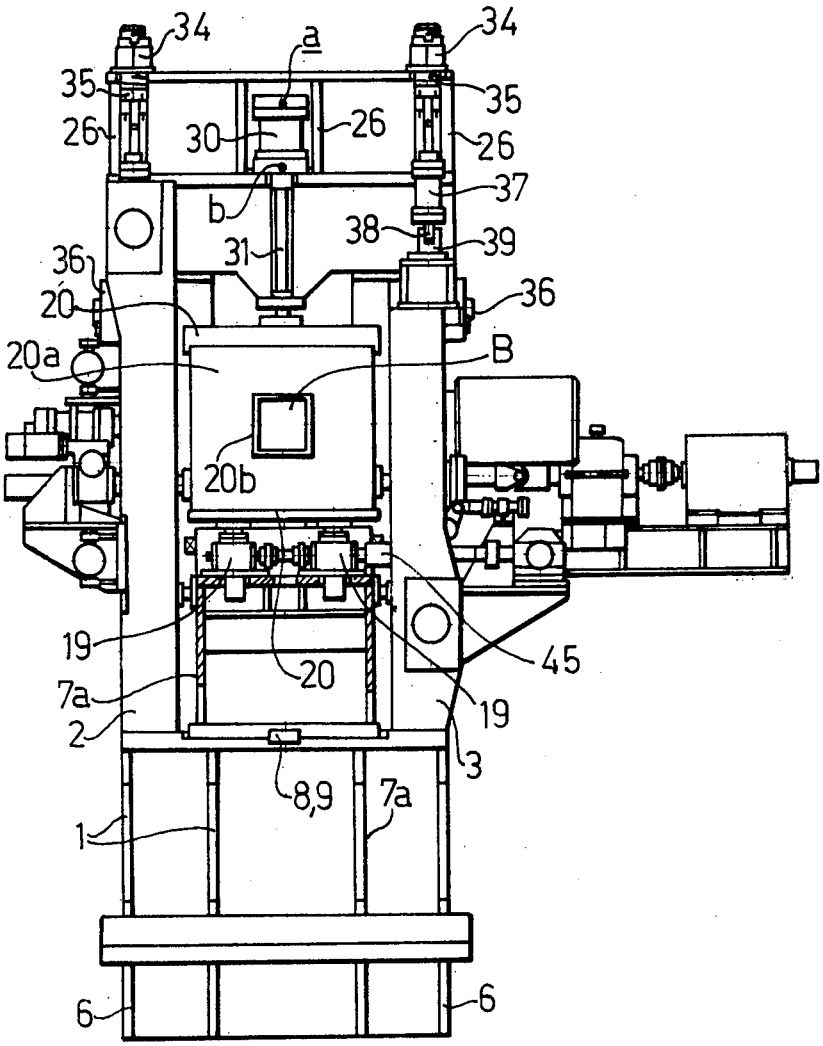
FIG. 3 is a diagram of the housing in FIG. 1, from the inlet side.

When the PPM has completed the production cycle for axially bored cylindrical blooms having a set diameter, so that it is necessary to change the calibre, the machine is stopped and the working unit therein is replaced by another, separately-prepared unit. The replacement operation is as follows:

The couplings 54 (FIG. 3) are disengaged in the control line indicated by the jacks 19 for adjusting the height of the roller guide 20, 21. Jacks 23 are moved into the retracted position, together with the oleodynamic cylinder 24 (FIG. 4) for laterally adjusting guide 20–21. Pressure is cut off from the top side *a* of the oleodynamic cylinders 27, 28 for reloading the housing, from the oleodynamic cylinder 30 for securing the inlet guide 20, 21 and from the oleodynamic cylinder 32 for securing the outlet guide 25. Pressure is applied to the bottom side *b* of oleodynamic cylinders 27, 28; by reaction, cap 26 descends until its bottom part bears on the top end of uprights 2, 3, 4, 5 and releases the nuts 34 securing tie-rods 35. By means of the oleodynamic cylinders 37, tie-rods 35 are moved through an angle around the associated pins 37, until they are outside cap 26.

Figure 4:
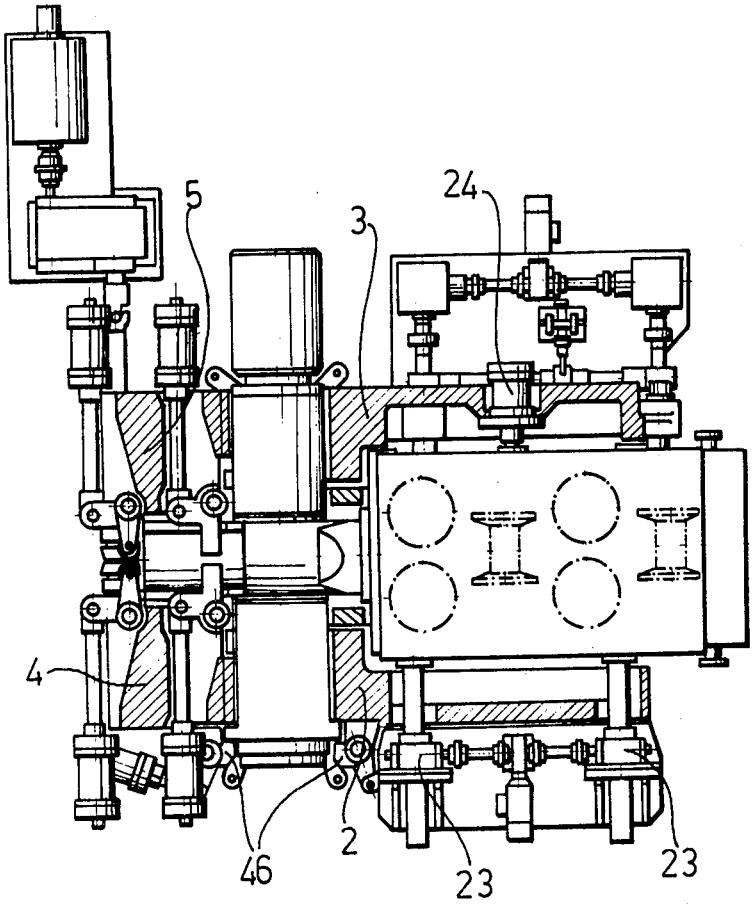
FIG. 4 is a horizontal sectional view of FIG. 1.

Next, shackles 29, which secure rods 27*a*, 28*a* of oleodynamic cylinders 27, 28 to the top chocks 13, 14 are released, after which cap 26 can be lifted by a crane, so as to release the top part of the cage. After releasing cap 26, the crane is used for lifting the complete previously-described working unit contained in frame 7, and replace it by a working unit which has been prepared outside the housing and is ready for the new calibre. The rolling house containing the new working unit is adjusted by the reverse operations from those previously described with regard to the dismantling of the first working unit. The new working unit is aligned as required with respect to the inlet and outlet sides of the housing and is secured by an abutment on the bottom side of the housing, against which the flanges of the top chocks 13, 14 and of the bottom chock 10 bear. Chock 10 is pressed against uprights 2 and 4 by a number of oleodynamically controlled valves 46 (FIG. 4).

At this point, couplings 45 of the control line of jacks 19 are re-inserted, and jacks 23 and the oleodynamic cylinder are placed against the inlet guide 20, 21. After the rolling housing has been fitted with the new working unit, the PPM is ready for a new production cycle. The aforementioned operations for replacing a working unit by a rolling housing containing a new, separately-prepared working unit takes only a few tens of minutes, and this is the main technical and economic advantage of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A housing for a rolling mill for producing axially bored cylindrical blooms from square bars, comprising:

a pair of cogging rollers having round grooves and associated bearing chocks mounted in the housing;

an inlet guide for bearing a square bar to be rolled;

an outlet guide for the bored, rolled cylinridical bloom; and means for adjustably positioning the inlet guide relative to the rolling axis, wherein the pair of cogging rollers, the associated bearing chocks, the inlet guide, the outlet guide and the means for adjustably positioning the inlet guide relative to the rolling axis form a monolithic working unit which can be fitted into and taken out of the housing.

2. A housing according to claim 1 comprising a frame in which the cogging rollers are removably mounted together with the associated chocks, the inlet guide, the outlet guide and the means for adjustably positioning the inlet guide, the frame being provided with means for removably engaging matching means for guiding the frame with which the housing is fitted.

* * * * *